US011852993B1

(12) United States Patent
Terashima et al.

(10) Patent No.: US 11,852,993 B1
(45) Date of Patent: Dec. 26, 2023

(54) TONER CONTAINER AND IMAGE FORMING APPARATUS

(71) Applicant: FUJIFILM Business Innovation Corp., Tokyo (JP)

(72) Inventors: Kento Terashima, Kanagawa (JP); Kiyoshi Sako, Kanagawa (JP); Keiji Sanekata, Kanagawa (JP); Chihiro Hagiwara, Kanagawa (JP); Masayuki Shimoda, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/984,329

(22) Filed: Nov. 10, 2022

(30) Foreign Application Priority Data

Jun. 14, 2022 (JP) ..... 2022-096076

(51) Int. Cl.
*G03G 15/08* (2006.01)

(52) U.S. Cl.
CPC ..... *G03G 15/0898* (2013.01); *G03G 15/0887* (2013.01)

(58) Field of Classification Search
CPC ..... G03G 15/0898; G03G 15/0887; G03G 15/087; G03G 15/0872; G03G 15/0881; G03G 2215/0668; G03G 2215/0663; G03G 2215/0665
See application file for complete search history.

(56) References Cited

U.S. PATENT DOCUMENTS

2009/0279916 A1* 11/2009 Naito ..... G03G 15/0872 399/106
2010/0239325 A1* 9/2010 Asai ..... G03G 15/0881 399/262
2011/0064479 A1* 3/2011 Sasaki ..... G03G 15/087 399/262
2012/0301188 A1* 11/2012 Yamabe ..... G03G 15/0872 399/262

FOREIGN PATENT DOCUMENTS

JP 10-213958 A 8/1998
JP 2007-316190 A 12/2007
JP 2009-276659 A 11/2009

* cited by examiner

*Primary Examiner* — Sandra Brase
(74) *Attorney, Agent, or Firm* — Sughrue Mion, PLLC

(57) ABSTRACT

A toner container includes: a container that accommodates toner and transports, by rotating, the toner to an opening disposed at a first end portion in a direction of a rotation axis; a support portion that covers a periphery of the container near the first end portion, and supports the container to be rotatable in a circumferential direction, the support portion being attached to an image forming apparatus body and having a sealant interposed between the support portion and the container; and a fixing portion that fixes the container and the support portion to each other while the sealant is compressed when the support portion is rotated relative to the container in a first circumferential direction.

20 Claims, 14 Drawing Sheets

TONER CONTAINER AND IMAGE FORMING APPARATUS

CROSS-REFERENCE TO RELATED APPLICATIONS

This application is based on and claims priority under 35 USC 119 from Japanese Patent Application No. 2022-096076 filed Jun. 14, 2022.

BACKGROUND

(i) Technical Field

The present disclosure relates to a toner container and an image forming apparatus.

(ii) Related Art

Japanese Unexamined Patent Application Publication No. 2009-276659 describes a toner cartridge that includes a toner container for accommodating toner, that transfers the toner in the toner container toward an opening with rotation of the toner container, and that includes a tube receiving member fixed to the opening of the toner container to receive a tubular member fixed to an image forming apparatus body.

Japanese Unexamined Patent Application Publication No. 10-213958 describes a toner cartridge that includes a cartridge body that accommodates toner and including a toner outlet in its bottom surface, and a sealant removably attached to the bottom surface of the cartridge body to close the toner outlet. The sealant is formed from a moisture-resistant material. A peripheral wall forming the cartridge body has a vent hole. The vent hole is closed by a breathable sealant formed from a breathable material. A bag formed from a flexible member having moisture resistance is attached to around the vent hole.

Japanese Unexamined Patent Application Publication No. 2007-316190 describes an image forming method enabling toner feeding, the method including fitting, to an image forming apparatus, a container accommodating toner with a volume median diameter (D50) of 3.5 to 8.5 μm containing a resin with a glass-transition temperature of 0 to 46° C. and a softening point of 75 to 110° C. The container is disposed in an outer container formed from a substance with a specific gravity of 0.1 to 0.3. A toner supplier forming the container is exposed from the outer container to be fitted to the image forming apparatus to enable toner feeding.

SUMMARY

Aspects of non-limiting embodiments of the present disclosure relate to a toner container and an image forming apparatus that further prevent toner fluidity deterioration caused by the influence of the humidity in a container than in a structure where a gap is formed between a support portion and a container.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a toner container comprising: a container that accommodates toner and transports, by rotating, the toner to an opening disposed at a first end portion in a direction of a rotation axis; a support portion that covers a periphery of the container near the first end portion, and supports the container to be rotatable in a circumferential direction, the support portion being attached to an image forming apparatus body and having a sealant interposed between the support portion and the container; and a fixing portion that fixes the container and the support portion to each other while the sealant is compressed when the support portion is rotated relative to the container in a first circumferential direction.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will be described below in detail with reference to the drawings.

First Exemplary Embodiment

First, an example of an image forming apparatus including a toner container according to a first exemplary embodiment will be described.

Image Forming Apparatus 10

Figure 1:
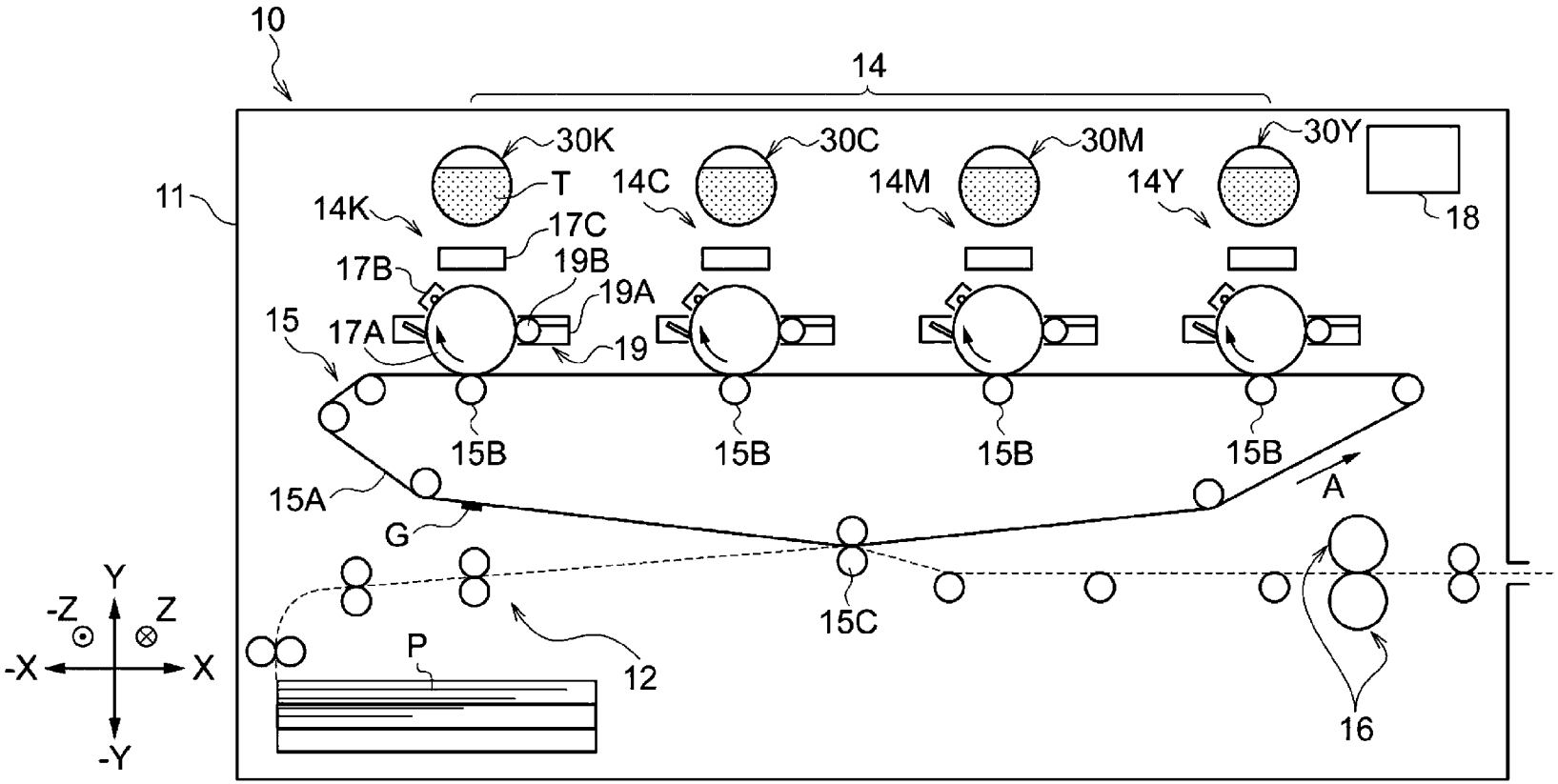
FIG. 1 is a schematic structure diagram of an example of an image forming apparatus including a toner cartridge according to a first exemplary embodiment.

FIG. 1 is a schematic structure diagram of an example of an image forming apparatus 10 according to the present exemplary embodiment. In the following description, a direction indicated with arrow Y in FIG. 1 denotes an apparatus height direction, and a direction indicated with arrow X in FIG. 1 denotes an apparatus width direction. The direction (indicated with Z) perpendicular to the apparatus height direction and the apparatus width direction denotes an apparatus depth direction. When the image forming apparatus 10 is viewed from the front, the apparatus height direction, the apparatus width direction, and the apparatus depth direction are indicated with a Y direction, a X direction, and a Z direction. When a first side of each of the X direction, the Y direction, and the Z direction is to be distinguished from a second side of the direction, the upper side or direction is referred to as a Y side or direction, the lower side or direction is referred to as a −Y side or direction, the right side or direction is referred to as an X side or direction, the left side or direction is referred to as a −X side or direction, the back side or direction is referred to as a Z side or direction, and the front side or direction is referred to as a −Z side or direction, when the image forming apparatus 10 is viewed from the front.

The image forming apparatus 10 includes an image forming apparatus body 11 that accommodates each component. The image forming apparatus 10 includes, inside the image forming apparatus body 11, for example, a transport portion 12, an image forming portion 14, a fixing portion 16, and a controller 18. The transport portion 12 transports a sheet P serving as an example of a recording medium.

The image forming portion 14 includes, for example, four image forming units 14Y, 14M, 14C, and 14K and a transfer device 15. The image forming portion 14 forms a toner image G with toner T on the sheet P transported by the transport portion 12. The fixing portion 16 fixes the toner image G with heat and pressure onto the sheet P. The controller 18 controls the operation of each component of the image forming apparatus 10.

The image forming units 14Y, 14M, 14C, and 14K have the same structure except for using different colors (yellow, magenta, cyan, and black) of the toner T. Thus, the image forming unit 14K will be described below, without describing the image forming units 14Y, 14M, and 14C.

The image forming unit 14K includes a photoconductor 17A serving as an example of an image carrier, a charging roller 17B, an exposure portion 17C, and a development device 19. The photoconductor 17A holds, on its outer circumferential surface, a latent image formed as a result of the photoconductor 17A being charged with electricity by the charging roller 17B and being exposed to light by the exposure portion 17C.

The development device 19 includes a box-shaped body portion 19A and a development roller 19B rotatably disposed in the body portion 19A. The body portion 19A stores a developer containing the toner T. The development device 19 develops a latent image on the photoconductor 17A with the toner T by rotating the development roller 19B. The toner T is fed into the body portion 19A from a toner cartridge 30K, described later.

The transfer device 15 includes an intermediate transfer belt 15A that rotates in a direction of arrow A, four first transfer rollers 15B that transfer toner images G from the photoconductors 17A to the intermediate transfer belt 15A, and a second transfer roller 15C that transfers the toner images G on the intermediate transfer belt 15A to the sheet P. The transfer device 15 transfers the developed toner images G on the photoconductor 17A to the sheet P.

As illustrated in FIG. 1, the image forming apparatus 10 includes toner cartridges 30Y, 30M, 30C, and 30K (referred to as toner cartridges 30Y to 30K, below) as examples of a toner container. The toner cartridges 30Y to 30K are disposed at the image forming apparatus body 11 in correspondence with respective colors (yellow, magenta, cyan, and black) of toner T.

Figure 2:
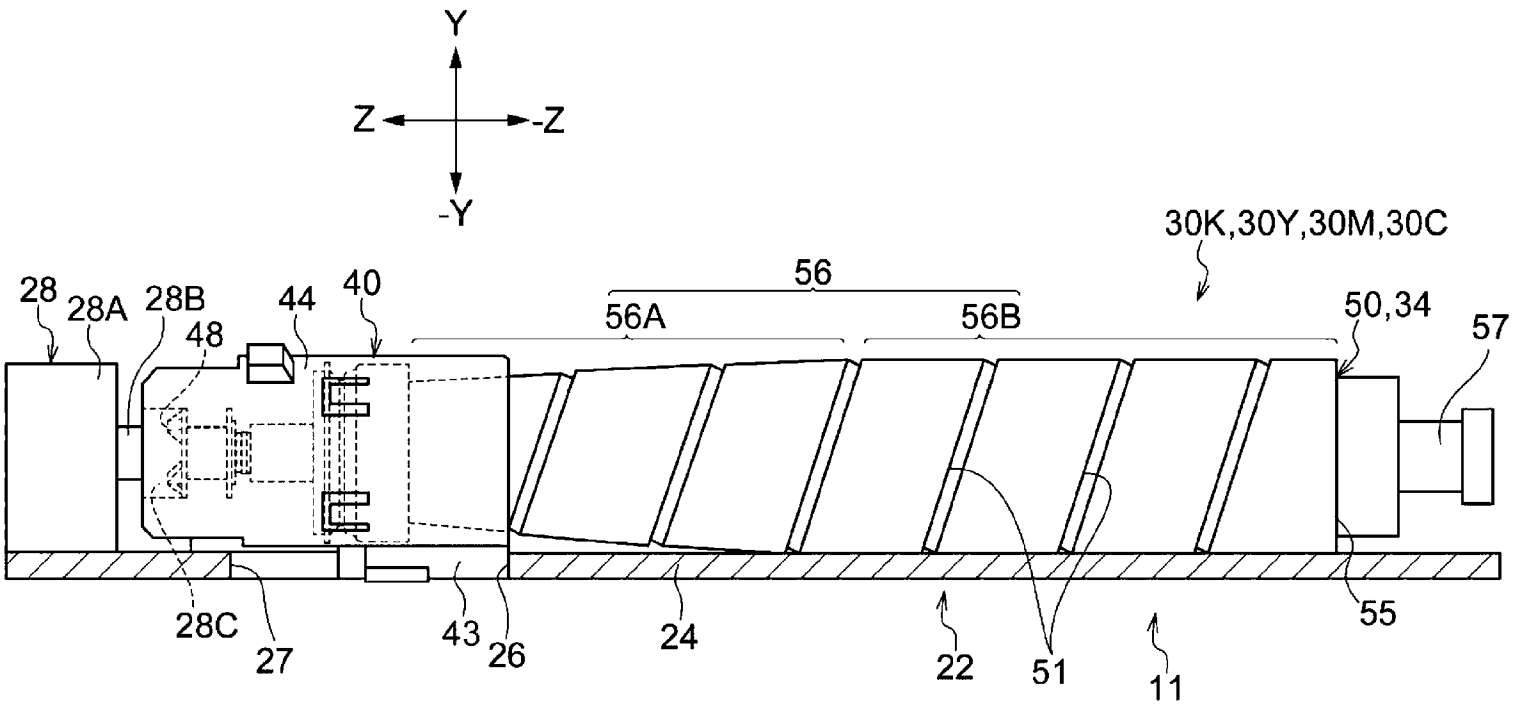
FIG. 2 is a schematic structure diagram of the toner cartridge, an attachment portion, and a motor according to the first exemplary embodiment.

As illustrated in FIG. 2, the image forming apparatus 10 includes attachment portions 22 to which the toner cartridges 30Y to 30K are attached, and motors 28 serving as examples of a driving portion that rotates a bottle portion 34 of each of the toner cartridges 30Y to 30K, described later.

The toner cartridges 30Y to 30K have the same structures, the attachment portions 22 have the same structures, and the motors 28 have the same structures. Thus, the toner cartridge 30K, the attachment portion 22 to which the toner cartridge 30K is attached, and the motor 28 for the toner cartridge 30K will be described below.

Attachment Portion 22

The attachment portion 22 has a function of receiving the toner cartridge 30K, and is fixed to an inner portion of the image forming apparatus body 11. More specifically, for example, as illustrated in FIG. 2, the attachment portion 22 includes a bottom plate 24 and a pair of side plates (not illustrated) that stand in the Y direction (upward) from both ends of the bottom plate 24 in the X direction, and has a U-shaped cross section when viewed in the Z direction.

The bottom plate 24 extends in a X-Z plane. The surface of the bottom plate 24 (surface facing in the Y direction) receives the toner cartridge 30K while having the axis direction aligned with the Z direction. The motor 28 is attached to a Z-side end portion of the bottom plate 24.

The bottom plate 24 has an opening 27 at a portion on the −Z side from a portion where the motor 28 is attached. The opening 27 allows the toner T discharged from the toner cartridge 30K to pass therethrough. The opening 27 extends through the bottom plate 24 in the vertical direction (the Y direction). When viewed in the Y direction (vertical direction), the opening 27 overlaps a discharge path (not illustrated) exposed while a shutter 43, described later, in the toner cartridge 30K is open.

The bottom plate 24 also has a recess 26 on the −Z side from the opening 27. The recess 26 allows the shutter 43 in the toner cartridge 30K to open. In the image forming apparatus 10, the toner cartridge 30K is attached to the attachment portion 22 as a result of being inserted in the depth direction of the image forming apparatus body 11. Specifically, at the attachment portion 22, the toner cartridge 30K is moved over the bottom plate 24 in the attachment portion 22 from the −Z side to the Z side to be attached to the bottom plate 24.

Motor 28

As illustrated in FIG. 2, the motor 28 includes a body 28A and a driving shaft 28B that rotates with its driving force. The driving shaft 28B extends from the body 28A toward the −Z side while having its axial direction aligned with the Z direction. At the distal end of the driving shaft 28B, a coupling 28C that is to be engaged with a coupling 48 in the toner cartridge 30K in the axial direction is disposed. The coupling 48 will be described later. While being attached to the attachment portion 22 in the toner cartridge 30K, the coupling 28C is engaged with the coupling 48 to transmit a rotational force (driving force) from the motor 28 to the coupling 48.

Toner Cartridge 30K

Figure 3:
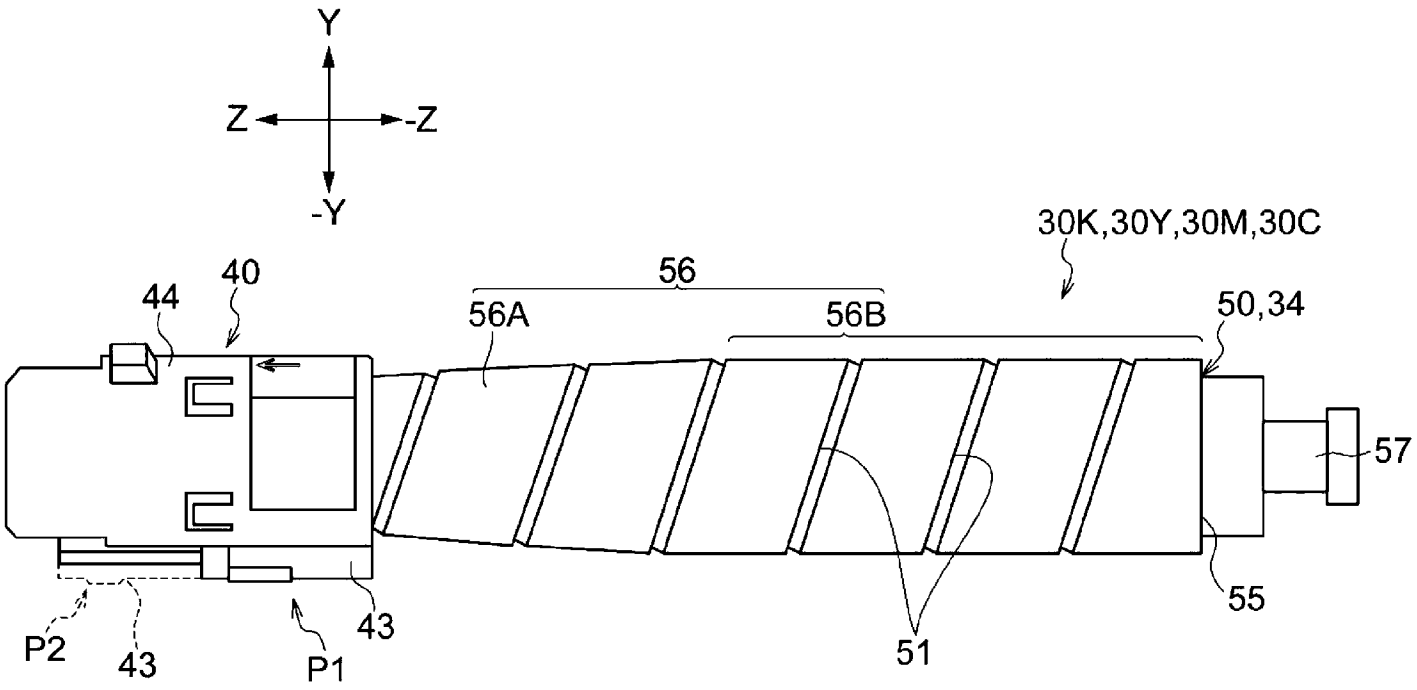
FIG. 3 is a side view of the toner cartridge according to the first exemplary embodiment.

As illustrated in FIG. 2 and FIG. 3, the toner cartridge 30K extends in the Z direction as a whole. More specifically, the toner cartridge 30K includes the bottle portion 34 serving as an example of a container, and a head portion 40 serving as an example of a support portion. The toner cartridge 30K also includes a fixing portion 80 that fixes the bottle portion 34 and the head portion 40 to each other (refer to FIG. 4). For ease of understanding the structure of the toner cartridge 30K, FIG. 3 omits illustration of the attachment portion 22 in the state where the toner cartridge 30K is attached to the attachment portion 22.

Bottle Portion 34

The bottle portion 34 includes a bottle body 50 that accommodates toner, and a receiving portion 60 (refer to FIG. 5) attached to a Z-side end portion of the bottle body 50, or an example of an end portion in the axial direction. The bottle body 50 is a closed-end member formed from resin and with a cylindrical shape having its axial direction aligned with the Z direction, and having the −Z side closed and the Z side open. Specifically, the bottle body 50 has an opening 56D (refer to FIG. 5 and FIG. 6) at the Z-side end portion (an example of a first end portion) and the −Z-side end portion closed. The bottle body 50 accommodates the toner T.

More specifically, as illustrated in FIG. 2 and FIG. 3, the bottle body 50 has a bottom wall 55, a peripheral wall 56, and a hold portion 57. The bottom wall 55 has a circular shape when viewed in the Z direction. The peripheral wall 56 has a cylindrical shape extending in the Z direction to the Z side from the outer peripheral portion of the bottom wall 55. More specifically, the peripheral wall 56 includes a trunk portion 56B with a predetermined outside diameter, and a reducing portion 56A that extends from the Z-side end portion of the trunk portion 56B toward the Z side while gradually reducing its diameter. More specifically, the trunk portion 56B forms the −Z-side portion of the peripheral wall 56 and has a uniform outside diameter.

Figure 5:
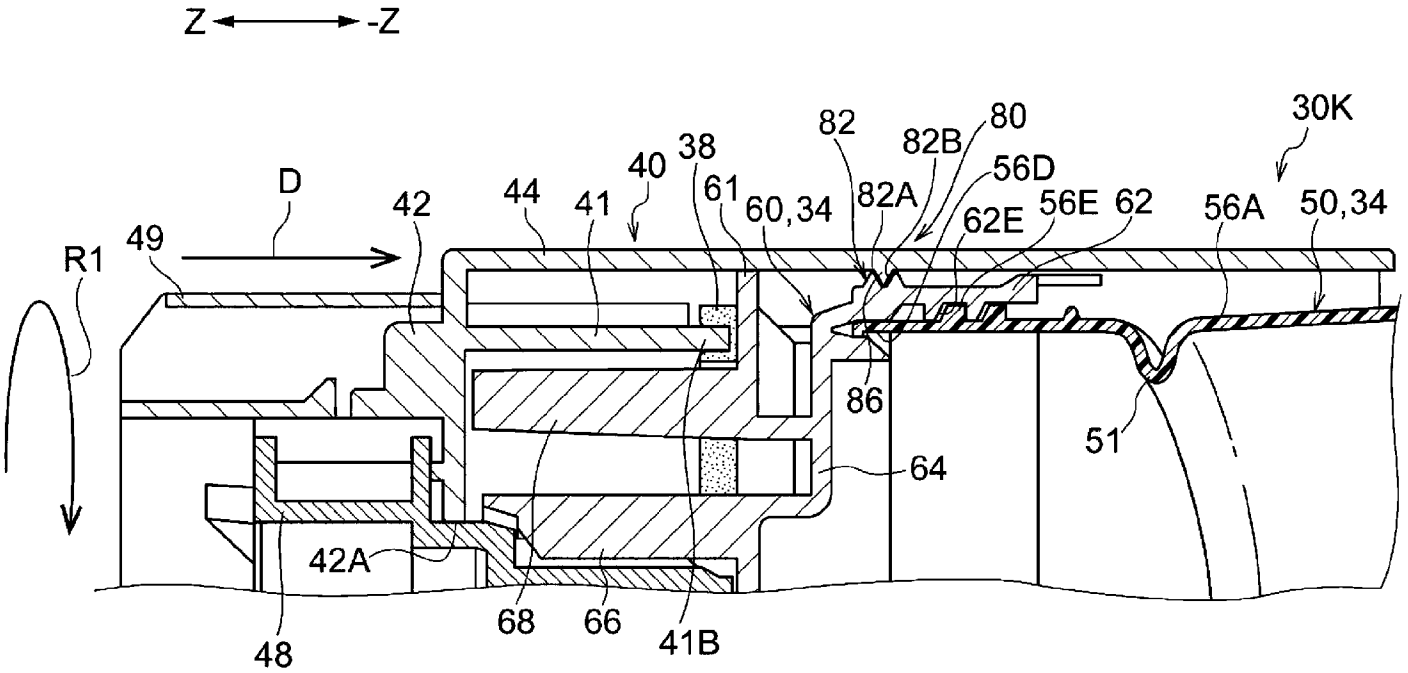
FIG. 5 is a cross-sectional view of a structure of part of the toner cartridge according to the first exemplary embodiment, at a portion around a sealant when a head portion is rotated relative to a bottle portion in a first circumferential direction.
Figure 6:
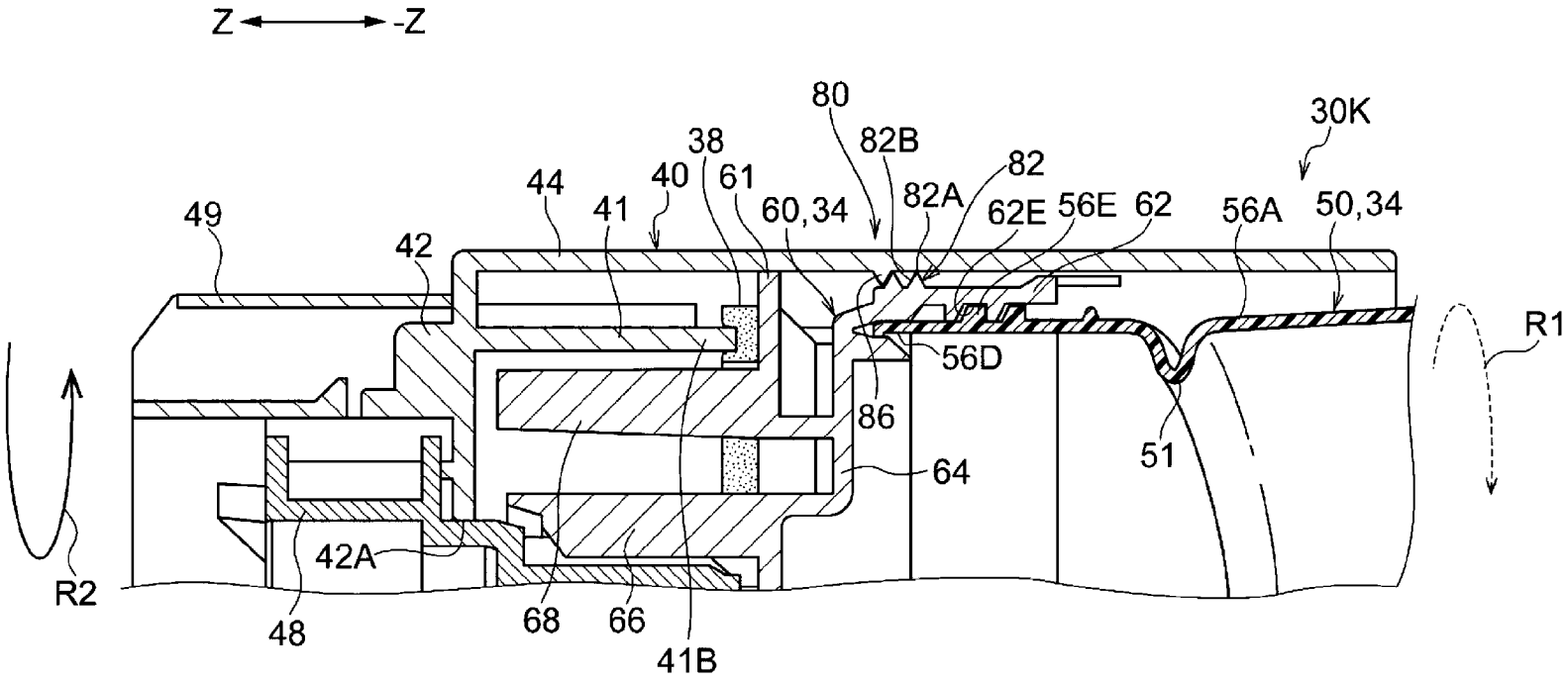
FIG. 6 is a cross-sectional view of a structure of part of the toner cartridge according to the first exemplary embodiment, at the portion around the sealant when the head portion is rotated relative to the bottle portion in a second circumferential direction.

As illustrated in FIG. 5 and FIG. 6, an external thread portion 56E for receiving the receiving portion 60 is disposed at the peripheral portion of the Z-side opening 56D in the peripheral wall 56.

As illustrated in FIG. 2 and FIG. 3, the peripheral wall 56 has a guide portion 51 extending helically and protruding to the inside of the peripheral wall 56. By rotating, the bottle body 50 transports the toner T accommodated therein with the guide portion 51 toward the opening 56D (to the −Z side).

The toner cartridge 30K is attached to the attachment portion 22 in the image forming apparatus body 11 from the Z-side end portion of the bottle body 50 (refer to FIG. 2). Specifically, the bottle body 50 is moved toward the Z side to be attached to the attachment portion 22.

The hold portion 57 is a portion held by an operator while the toner cartridge 30K is attached to the attachment portion 22. As illustrated in FIG. 2, the hold portion 57 protrudes from the bottom wall 55 to the −Z side. Specifically, the hold portion 57 is disposed at the −Z-side end portion of the bottle body 50.

The receiving portion 60 is attached to the bottle body 50 to be integrated with the bottle body 50. The receiving portion 60 is symmetric with respect to the Y direction, and thus, FIG. 5 omits illustration of the −Y side. The receiving portion 60 includes, for example, a peripheral wall 62, a partitioning wall 64, a shaft portion 66, and agitation protrusions 68. The peripheral wall 62 has a cylindrical shape extending in the Z direction. An internal thread portion 62E to be engaged with the external thread portion 56E is formed on the inner peripheral surface of the peripheral wall 62. When the internal thread portion 62E is engaged with the external thread portion 56E in the bottle body 50, the receiving portion 60 is attached to the Z-side end portion of the bottle body 50 to be integrally rotatable with the bottle body 50.

The partitioning wall 64 extends in the Y direction. For example, the center portion of the partitioning wall 64 is bent toward the Z side. Although not illustrated, the partitioning wall 64 has multiple openings that allow the toner T in the bottle body 50 to pass therethrough to the Z side.

The shaft portion 66 extends from the bent portion of the partitioning wall 64 toward the Z side while having its axial direction aligned with the Z direction. As illustrated in FIG. 2, the coupling 48 engaged with the coupling 28C in the motor 28 in the axial direction is fixed to the shaft portion 66. When the coupling 48 is engaged with the coupling 28C, the rotational force (driving force) of the motor 28 is transmitted to the receiving portion 60. Thus, the receiving portion 60 rotates together with the bottle body 50 while having its axial direction (Z direction) serving as a rotation axial direction.

As illustrated in FIG. 5, the agitation protrusions 68 extend to the Z side from a radially middle portion of the partitioning wall 64 while having its axial direction aligned with the Z direction. An annular wall 61 is disposed at a portion of each agitation protrusion 68 located closer to the partitioning wall 64 to extend radially outward in the Y direction. For example, the agitation protrusions 68 disposed at multiple positions on the partitioning wall 64 agitate the toner T moved into the head portion 40 to discharge the toner T.

Head Portion 40

The head portion 40 is formed from a closed-end member with a cylindrical shape having its axial direction aligned with the Z direction, and having the Z side closed and the −Z side open. The head portion 40 is, for example, formed from resin.

As illustrated in FIG. 5, the head portion 40 includes a circular wall 42, an outer peripheral wall 44, an inner peripheral wall 41, and a tubular portion 49. The circular wall 42 is formed in a circular shape when viewed in the Z direction. The circular wall 42 has a circular hole 42A that extends through in the Z direction at the center portion when viewed in the Z direction. The circular wall 42 supports the coupling 48 to be rotatable at the circular hole 42A. Thus, the receiving portion 60 to which the coupling 48 is fixed and the bottle portion 34 including the bottle body 50 to which the receiving portion 60 is attached are rotatably supported by the head portion 40. Thus, the head portion 40 supports the bottle portion 34 via the coupling 48 at an end portion in a first axial direction (on the Z side). In other words, the head portion 40 is attached to the bottle portion 34 to be rotatable in the circumferential direction.

The tubular portion 49 extends to the Z side from the circular wall 42 while having its axial direction aligned with the Z direction. The tubular portion 49 surrounds the periphery of the circular hole 42A when viewed in the Z direction. A portion of the coupling 48 engaged with the coupling 28C is disposed in the tubular portion 49.

The outer peripheral wall 44 has a cylindrical shape that extends from the outer peripheral portion of the circular wall 42 toward the −Z side in the Z direction. The outer peripheral wall 44 extends to the −Z side (−Z-side end portion of the bottle body 50) beyond an attachment position where the receiving portion 60 is attached to the bottle body 50 (a position where the external thread portion 56E and the internal thread portion 62E are engaged). The outer peripheral wall 44 covers a first end portion of the bottle body 50 and the periphery of the receiving portion 60 while leaving a gap between itself and the bottle body 50.

The inner peripheral wall 41 has a cylindrical shape that extends from the circular wall 42 on the inner periphery of the outer peripheral wall 44 to the −Z side in the Z direction. Although not illustrated, the internal space defined by the inner peripheral wall 41 serves as a space into which the toner T discharged from the bottle body 50 flows.

The sealant 38 is interposed between the bottle portion 34 and the head portion 40. In the first exemplary embodiment, the sealant 38 is held between a −Z-side end portion 41B of the inner peripheral wall 41 in the head portion 40 and the annular wall 61 in the receiving portion 60 in the bottle portion 34. The sealant 38 has an annular shape when viewed in the Z direction, and is continuously disposed between the −Z-side end portion 41B in the inner peripheral wall 41 and the annular wall 61 in the receiving portion 60. The sealant 38 includes, for example, a recess into which the end portion 41B of the inner peripheral wall 41 is inserted.

The sealant 38 is, for example, formed from a foamed elastic member (for example, polyurethane foam), and is compressively deformable. The sealant 38 is breathable as forming, for example, continuous bubbles at least partially connected to each other. In FIG. 5, the sealant 38 is compressed between the end portion 41B of the inner peripheral wall 41 and the annular wall 61 in the receiving portion 60. In the state where the sealant 38 is compressed, the space in the bubbles in the sealant 38 is squashed to reduce the breathability of the sealant 38.

Although not illustrated, the inner peripheral wall 41 defines, at the bottom portion (−Y-side portion), a discharge path along which the toner T is discharged to the outside of the outer peripheral wall 44. The shutter 43 that opens and closes is disposed outside (−Y side) of the discharge path in the outer peripheral wall 44 (refer to FIG. 2). The shutter 43 is attached to the outer side of the outer peripheral wall 44 to be movable in the Z direction. As illustrated in FIG. 2, in an attachment operation where the toner cartridge 30K is moved to the Z side, the shutter 43 fits into the recess 26 in the attachment portion 22. When the toner cartridge 30K moves further to the Z side while the shutter 43 fits to the recess 26, the shutter 43 moves to an open position. For example, in the toner cartridge 30K, the distance between the end portion 41B of the inner peripheral wall 41 and the annular wall 61 does not change between when the shutter 43 is in the open position (a position P1 illustrated in FIG. 3) and in a closed position (a position P2 illustrated in FIG. 3) (refer to FIG. 5).

The operation of moving the toner cartridge 30K further to the Z side engages the coupling 48 with the coupling 28C. When the coupling 48 is engaged with the coupling 28C, the head portion 40 is positioned to the image forming apparatus body 11 with the attachment portion 22 in between.

Fixing Portion 80

Figure 4:
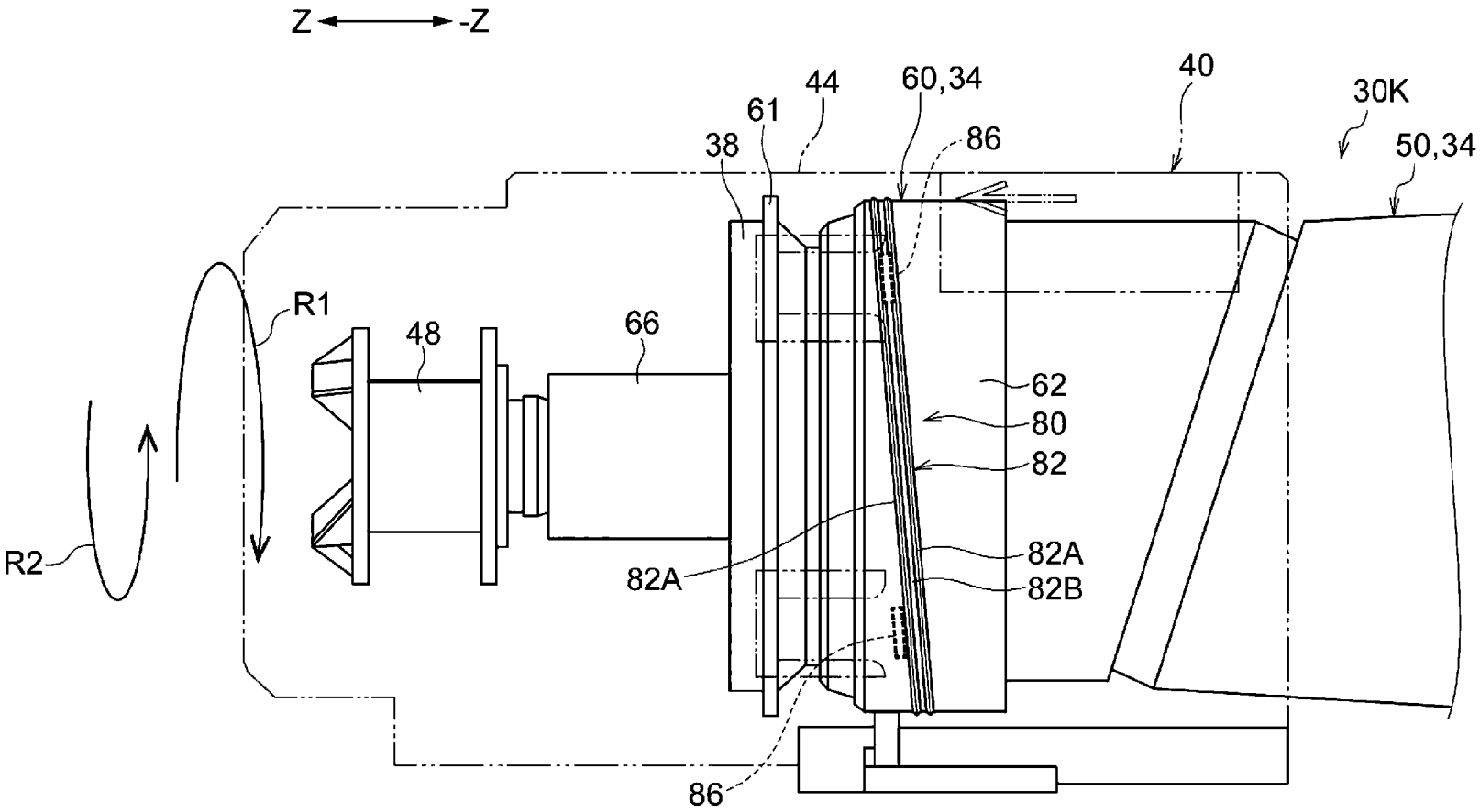
FIG. 4 is a side view of a structure of part of the toner cartridge according to the first exemplary embodiment.

As illustrated in FIG. 4 and FIG. 5, the fixing portion 80 fixes the bottle portion 34 and the head portion 40 to each other when the head portion 40 is rotated relative to the bottle portion 34 in the first circumferential direction. Specifically, the fixing portion 80 keeps the bottle portion 34 and the head portion 40 fixed to each other. At this time, the fixing portion 80 fixes the receiving portion 60 and the head portion 40 to each other while compressing the sealant 38 between the end portion 41B of the inner peripheral wall 41 and the annular wall 61 in the receiving portion 60 (refer to FIG. 5).

More specifically, the fixing portion 80 includes a screw portion 82 that protrudes radially outward from the outer peripheral surface of the peripheral wall 62 in the receiving portion 60 in the bottle portion 34, and projections 86 that protrude radially inward from the inner peripheral surface of the outer peripheral wall 44 in the head portion 40. The projections 86 are engaged with the screw portion 82. For example, the screw portion 82 includes two helical screw threads 82A and one thread groove 82B formed between the screw threads 82A. The thread groove 82B has, for example, a triangular shape.

The projections 86 are multiple pieces divided in the helical direction of the screw portion 82. In other words, for example, the projections 86 are multiple pieces located to be engaged with the thread groove 82B in the screw portion 82 (refer to FIG. 4). Providing many projections 86 may hinder unfastening of the bottle portion 34 and head portion 40 from each other. Thus, two or three projections 86 are preferably provided. The first exemplary embodiment includes two projections 86. For example, the thread groove 82B is a triangular groove, and the projections 86 are triangular projections engaged with the thread groove 82B.

When the head portion 40 is rotated relative to the bottle portion 34 in the first circumferential direction (direction of arrow R1) while the head portion 40 is pressed against the receiving portion 60 in the bottle portion 34, the projections 86 in the head portion 40 are fastened to the screw portion 82 in the receiving portion 60. For example, the direction of arrow R1 is a direction in which the head portion 40 is rotated rightward relative to the bottle portion 34. When the projections 86 are fastened to the screw portion 82, the head portion 40 is moved in the −Z direction (direction of arrow D) relative to the receiving portion 60 in the bottle portion 34, and the bottle portion 34 and the head portion 40 are fixed to each other while the sealant 38 is compressed. At this time, "rotating the head portion 40 relative to the bottle portion 34 in the first circumferential direction (direction of arrow R1)" also includes a case where, for example, the receiving portion 60 is rotated in a direction opposite to arrow R1 while the head portion 40 is stationary.

As illustrated in FIG. 5, when the head portion 40 is rotated relative to the bottle portion 34 in the first circumferential direction (direction of arrow R1), the distance between the end portion 41B of the inner peripheral wall 41 and the annular wall 61 in the receiving portion 60 is reduced, and thus the sealant 38 is compressed. Thus, the inside of the bottle portion 34 is left airtight to shut down an air inflow from the outside to the inside of the bottle portion 34. In this case, the airtight state is a state where, compared to the case where the sealant 38 is not compressed, the air flow from the sealant 38 is reduced, and the end portion 41B of the inner peripheral wall 41 and the annular wall 61 are tightly shut without leaving a gap therebetween with the compression of the sealant 38, that is, the space between the end portion 41B of the inner peripheral wall 41 and the annular wall 61 is sealed with the compression of the sealant 38. For example, when compressed, the sealant 38 has a thickness of smaller than or equal to ⅔ of the thickness of the sealant 38 not compressed, more preferably, smaller than or equal to a half of the thickness of the sealant 38 not compressed, or more preferably smaller than or equal to ⅓ of the thickness of the sealant 38 not compressed.

For example, during transportation of the toner cartridge 30K, the fixing portion 80 fixes the bottle portion 34 and the head portion 40 to each other while compressing the sealant 38.

As illustrated in FIG. 6, when the head portion 40 is rotated relative to the bottle portion 34 in the second circumferential direction (direction of arrow R2), the fixing portion 80 unfastens the receiving portion 60 and the head portion 40 from each other to release the sealant 38 from the compression (refer to FIG. 4). Specifically, when the head portion 40 is rotated relative to the bottle portion 34 in the second circumferential direction (direction of arrow R2), the distance between the end portion 41B of the inner peripheral wall 41 and the annular wall 61 in the receiving portion 60 increases, and thus the compression of the sealant 38 is released. When the compression of the sealant 38 is released, the sealant 38 with breathability allows air to flow therethrough between the end portion 41B of the inner peripheral wall 41 and the annular wall 61 in the receiving portion 60.

In the state where the toner cartridge 30K is attached to the attachment portion 22 in the image forming apparatus body 11, engagement of the coupling 48 with the coupling 28C transmits the rotational force (driving force) of the motor 28 to the receiving portion 60 in the bottle portion 34. In the first exemplary embodiment, when the rotational force (driving force) of the motor 28 is transmitted to the bottle portion 34 while the head portion 40 is fixed to the attachment portion 22, the bottle portion 34 (that is, the receiving portion 60) is rotated in the direction the same as the direction of arrow R1. Thus, the head portion 40 is rotatable relative to the bottle portion 34 (that is, the receiving portion 60) in the second circumferential direction (direction of arrow R2). In this case, "rotating the head portion 40 relative to the bottle portion 34 in the second circumferential direction (direction of arrow R2)" includes a case of rotating the bottle portion 34 in a direction opposite to arrow R2 while the head portion 40 is stationary. The direction in which the head portion 40 is rotated relative to the receiving portion 60 in the second circumferential direction (direction of arrow R2) is the same as the direction in which toner is transported with the rotation of the bottle portion 34.

Toner Cartridge According to Comparative Example

In this case, a structure of a toner cartridge 200 according to a comparative example and an issue of the toner cartridge 200 will be described.

Figure 13:
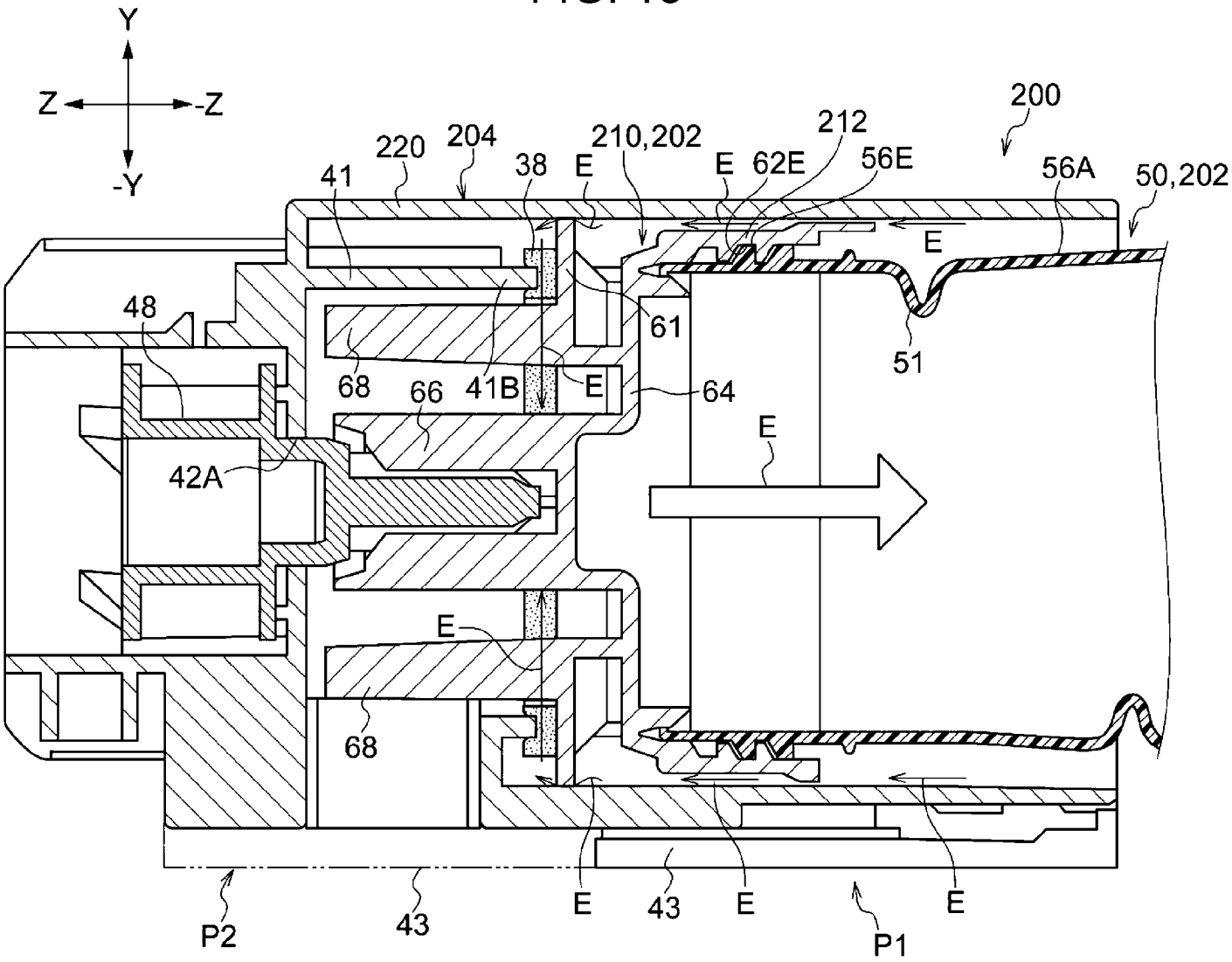
FIG. 13 is a cross-sectional view of a structure of part of a toner cartridge according to a comparative example.

FIG. 13 illustrates part of the toner cartridge 200 according to a comparative example. As illustrated in FIG. 13, the toner cartridge 200 includes a bottle portion 202, and a head portion 204 attached to the Z-side end portion of the bottle portion 202. The bottle portion 202 includes a bottle body 50 and a receiving portion 210 attached to the Z-side end portion of the bottle body 50.

The receiving portion 210 includes a peripheral wall 212 and an annular wall 61. The peripheral wall 212 has, in an inner peripheral surface, an internal thread portion 62E that is engaged with the external thread portion 56E in the bottle body 50. The outer peripheral surface of the peripheral wall 212 is a smooth surface having the outside diameter on the −Z side greater than the outside diameter on the Z side.

The head portion 204 includes the inner peripheral wall 41 and an outer peripheral wall 220. The inner peripheral surface of the outer peripheral wall 220 is uniform in the axial direction, and the outer peripheral wall 220 has a uniform inside diameter in the axial direction. The outer peripheral wall 220 in the head portion 204 and the peripheral wall 212 in the receiving portion 210 are spaced apart from each other. A gap is left between the outer peripheral wall 220 in the head portion 204 and the peripheral wall 212 in the receiving portion 210 to extend in the axial direction. Specifically, unlike in the first exemplary embodiment, no fixing portion is disposed between the outer peripheral wall 220 in the head portion 204 and the peripheral wall 212 in the receiving portion 210.

The sealant 38 is held between the −Z-side end portion 41B in the inner peripheral wall 41 in the head portion 204 and the annular wall 61 in the receiving portion 210. The head portion 204 is supported by the receiving portion 210 to be rotatable relative to the receiving portion 210 in the circumferential direction. In this state, the distance between the end portion 41B of the inner peripheral wall 41 and the annular wall 61 is the same as the distance when the toner cartridge 30K according to the first exemplary embodiment illustrated in FIG. 6 is unfastened. Thus, the sealant 38 is scarcely compressed, and allows air to flow therethrough. The distance between the end portion 41B of the inner peripheral wall 41 and the annular wall 61 does not change between when the shutter 43 is in the open position (a position P1 illustrated in FIG. 13) and in the closed position (a position P2 illustrated in FIG. 13). Other components in the toner cartridge 200 are the same as those in the toner cartridge 30K according to the first exemplary embodiment.

In the toner cartridge 200 according to the comparative example, as indicated with arrows E, outside air flows through between the outer peripheral wall 220 in the head portion 204 and the peripheral wall 212 in the receiving portion 210, and flows into the head portion 204 through the gap between the annular wall 61 and the outer peripheral wall 220. In addition, as indicated with arrows E, the outside air flows into the bottle portion 202 through the sealant 38 between the annular wall 61 and the −Z-side end portion 41B in the inner peripheral wall 41. When the toner cartridge 200 is exposed to a hot and humid environment during transportation from manufacture to a customer, the toner inside the toner cartridge 200 may degrade, and the toner fluidity may be lowered.

Figure 14:
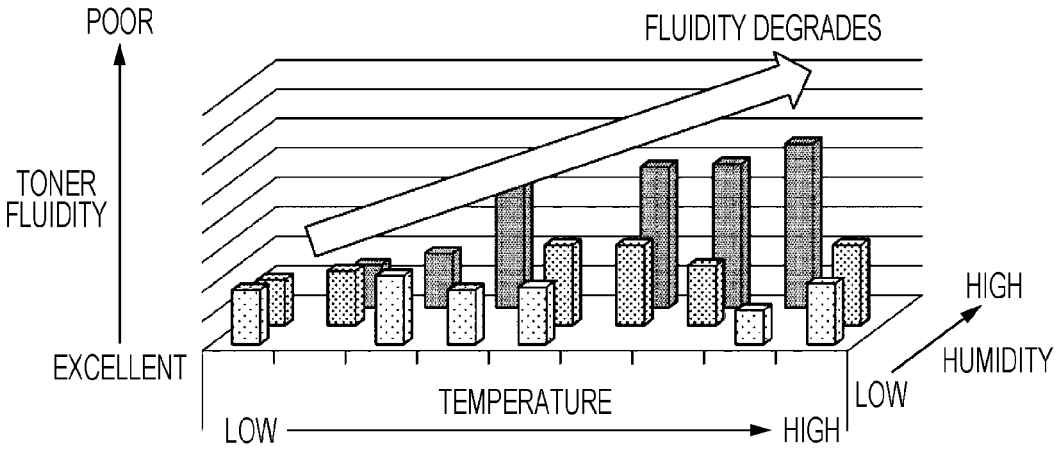
FIG. 14 is a graph showing the relationship between temperature, humidity, and toner fluidity.

FIG. 14 is a graph showing the relationship between humidity, temperature, and toner fluidity. As illustrated in FIG. 14, even high temperature alone slightly lowers toner fluidity. High temperature and high humidity increasingly degrade the toner, and lower the toner fluidity.

Figure 15:
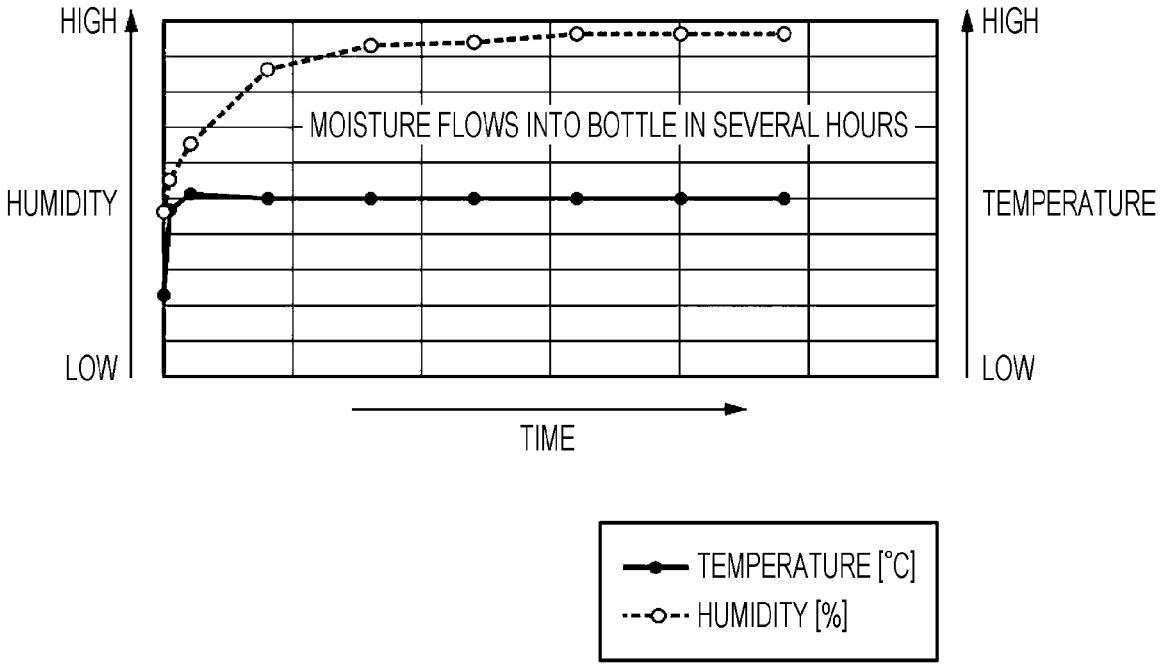
FIG. 15 is a graph showing a transition of the temperature and the humidity in the toner cartridge in relation to time for which the toner cartridge is placed in a hot and humid chamber.

FIG. 15 is a graph showing transition of the temperature and the humidity in the toner cartridge 200 in relation to time for which the toner cartridge 200 is placed in a hot and humid chamber. As illustrated in FIG. 15, the temperature in the toner cartridge 200 immediately rises to the set temperature for the chamber, whereas the humidity in the toner cartridge 200 gradually rises to around the set humidity for the chamber. For example, the moisture flows into the toner cartridge 200 from the outside within several hours. This graph shows that although reduction of the influence of the temperature in the toner cartridge is difficult, the humidity inside the toner cartridge varies depending on the structure of the toner cartridge.

To reduce the influence of the humidity on the toner in a toner cartridge, enhancing airtightness of the toner cartridge itself is conceivable as an example. However, enhancement of airtightness of the toner cartridge may produce a difference in air pressure when the toner cartridge is attached to the attachment portion in the image forming apparatus body, and toner may fail to be normally discharged from the toner cartridge. To address this, the influence of the humidity on the toner cartridge during transportation is to be reduced, and the production of the difference in air pressure is to be avoided when the toner cartridge is attached to the image forming apparatus body.

Operations of First Exemplary Embodiment

Now, the operations of the first exemplary embodiment will be described.

The toner cartridge 30K includes the fixing portion 80 that fixes the bottle portion 34 and the head portion 40 to each other while compressing the sealant 38 interposed between the bottle portion 34 and the head portion 40. As illustrated in FIG. 4 and FIG. 5, the fixing portion 80 fixes the bottle portion 34 and the head portion 40 to each other when rotating the head portion 40 relative to the bottle portion 34 in the first circumferential direction (direction of arrow R1). At this time, the fixing portion 80 fixes the receiving portion 60 and the head portion 40 to each other while compressing the sealant 38 between the end portion 41B of the inner peripheral wall 41 and the annular wall 61 in the receiving portion 60 (refer to FIG. 5).

In the first exemplary embodiment, the fixing portion 80 includes the screw portion 82 that protrudes radially outward from the outer peripheral surface of the peripheral wall 62 in the receiving portion 60 in the bottle portion 34, and the projections 86 that protrude radially inward from the inner peripheral surface of the outer peripheral wall 44 in the head portion 40 and that are engaged with the screw portion 82. When the head portion 40 is rotated relative to the bottle portion 34 in the first circumferential direction (direction of arrow R1) while the head portion 40 is pressed against the receiving portion 60 in the bottle portion 34, the projections 86 in the head portion 40 are fastened to the screw portion 82 in the receiving portion 60. Thus, the distance between the end portion 41B of the inner peripheral wall 41 in the head portion 40 and the annular wall 61 in the receiving portion 60 in the bottle portion 34 is reduced, and the sealant 38 is compressed. Thus, the inside of the bottle portion 34 is in an airtight state, and an air flow from the outside into the toner cartridge 30K is blocked.

When the toner cartridge 30K is attached to the attachment portion 22 in the image forming apparatus body 11, as illustrated in FIG. 4 and FIG. 6, the head portion 40 is rotated relative to the bottle portion 34 in the second circumferential direction (direction of arrow R2) to unfasten the receiving portion 60 and the head portion 40 from each other to release the sealant 38 from the compression. Specifically, when the head portion 40 is rotated relative to the bottle portion 34 in the second circumferential direction (direction of arrow R2), the distance between the end portion 41B of the inner peripheral wall 41 and the annular wall 61 in the receiving portion 60 increases, and the sealant 38 is released from the compression.

In the first exemplary embodiment, while the head portion 40 is fixed to the attachment portion 22, the rotational force (driving force) of the motor 28 is transmitted to the bottle portion 34 to rotate the bottle portion 34 (that is, the receiving portion 60) in the direction the same as the direction of arrow R1. Thus, the head portion 40 is rotated relative to the bottle portion 34 (that is, the receiving portion 60) in the second circumferential direction (direction of arrow R2).

The sealant 38 has breathability. Thus, when the sealant 38 is released from the compression, air is allowed to flow through the sealant 38 between the end portion 41B of the inner peripheral wall 41 and the annular wall 61 in the receiving portion 60. This structure prevents a production of the difference in air pressure when the toner cartridge 30K is attached to the attachment portion 22 in the image forming apparatus body 11.

In the toner cartridge 30K, the fixing portion 80 fixes the bottle portion 34 and the head portion 40 to each other while the sealant 38 is compressed. Thus, compared to a structure including a gap between the head portion and the bottle portion, the toner cartridge 30K prevents toner fluidity deterioration caused by the influence of the humidity in the bottle portion 34.

In the toner cartridge 30K, the sealant 38 has breathability. Compared to a structure including a nonbreathing sealant interposed between the bottle portion and the head portion, the toner cartridge 30K reduces toner discharge failures caused by the difference in air pressure between the inside and the outside of the bottle portion 34.

In the toner cartridge 30K, the fixing portion 80 rotates the head portion 40 relative to the bottle portion 34 in the second circumferential direction (direction of arrow R2) with the rotational force transmitted from the motor 28 in the image forming apparatus body 11. In the first exemplary embodiment, the rotational force of the motor 28 is transmitted to the bottle portion 34 while the head portion 40 is fixed to the attachment portion 22 to rotate the bottle portion 34 (that is, the receiving portion 60) in the direction the same as the direction of arrow R1. Thus, the head portion 40 is rotated relative to the bottle portion 34 (that is, the receiving portion 60) in the second circumferential direction (direction of arrow R2). Thus, the bottle portion 34 and the head portion 40 are unfastened from each other to release the sealant 38 from the compression. Thus, the toner cartridge 30K is more easily operable than a structure where the head portion is manually rotated relative to the bottle portion in the second circumferential direction.

In the toner cartridge 30K, the direction in which the head portion 40 is rotated relative to the bottle portion 34 (that is, the receiving portion 60) in the second circumferential direction (direction of arrow R2) is the same as the direction in which the toner is transported with the rotation of the bottle portion 34. Thus, in the toner cartridge 30K, the bottle portion 34 is rotatable in the toner transport direction via the head portion 40 with the rotational force transmitted from the motor 28 in the image forming apparatus body 11, unlike in the structure where the head portion is rotated relative to the bottle portion in a direction opposite to the direction in which the toner is transported with rotation of the bottle portion.

In the toner cartridge 30K, the fixing portion 80 includes the screw portion 82 disposed at the peripheral wall 62 in the receiving portion 60 in the bottle portion 34, and the projections 86 disposed at the outer peripheral wall 44 in the head portion 40. The projections 86 are fastened to the screw portion 82 by rotating the head portion 40 relative to the bottle portion 34 in the first circumferential direction (direction of arrow R1). Thus, in the toner cartridge 30K, the head portion 40 and the bottle portion 34 are easily fixed to each other compared to a structure where the fixing portion includes one protrusion and one groove.

In the toner cartridge 30K, the fixing portion 80 includes the screw portion 82 disposed at the peripheral wall 62 in the receiving portion 60 in the bottle portion 34, and the projections 86 disposed at the outer peripheral wall 44 in the head portion 40. Thus, the screw portion 82 and the projections 86 in the toner cartridge 30K are easily manufacturable than a structure including a projection disposed at the bottle portion and a screw portion disposed at the head portion.

In the toner cartridge 30K, the projections 86 are multiple pieces arranged in the helical direction of the screw portion 82. Compared to a structure including one projection, the toner cartridge 30K stably keeps the bottle portion 34 and the head portion 40 fixed to each other (that is, the positions of the bottle portion 34 and the head portion 40) while the sealant 38 is compressed.

The image forming apparatus 10 includes the image forming apparatus body 11, the photoconductor 17A that is disposed in the image forming apparatus body 11 to receive latent images, the development devices 19 disposed in the image forming apparatus body 11 to develop the latent images, and the toner cartridges 30K to 30Y that accommodate toner to be fed to the development devices 19. Thus, compared to the structure including a gap between the head portion and the bottle portion, the image forming apparatus 10 prevents toner fluidity deterioration caused by the influence of the humidity, and prevents deterioration of the image quality.

Second Exemplary Embodiment

Subsequently, a toner container according to a second exemplary embodiment will be described. Components the same as those in the first exemplary embodiment will be denoted with the same reference signs without being described.

Figure 7:
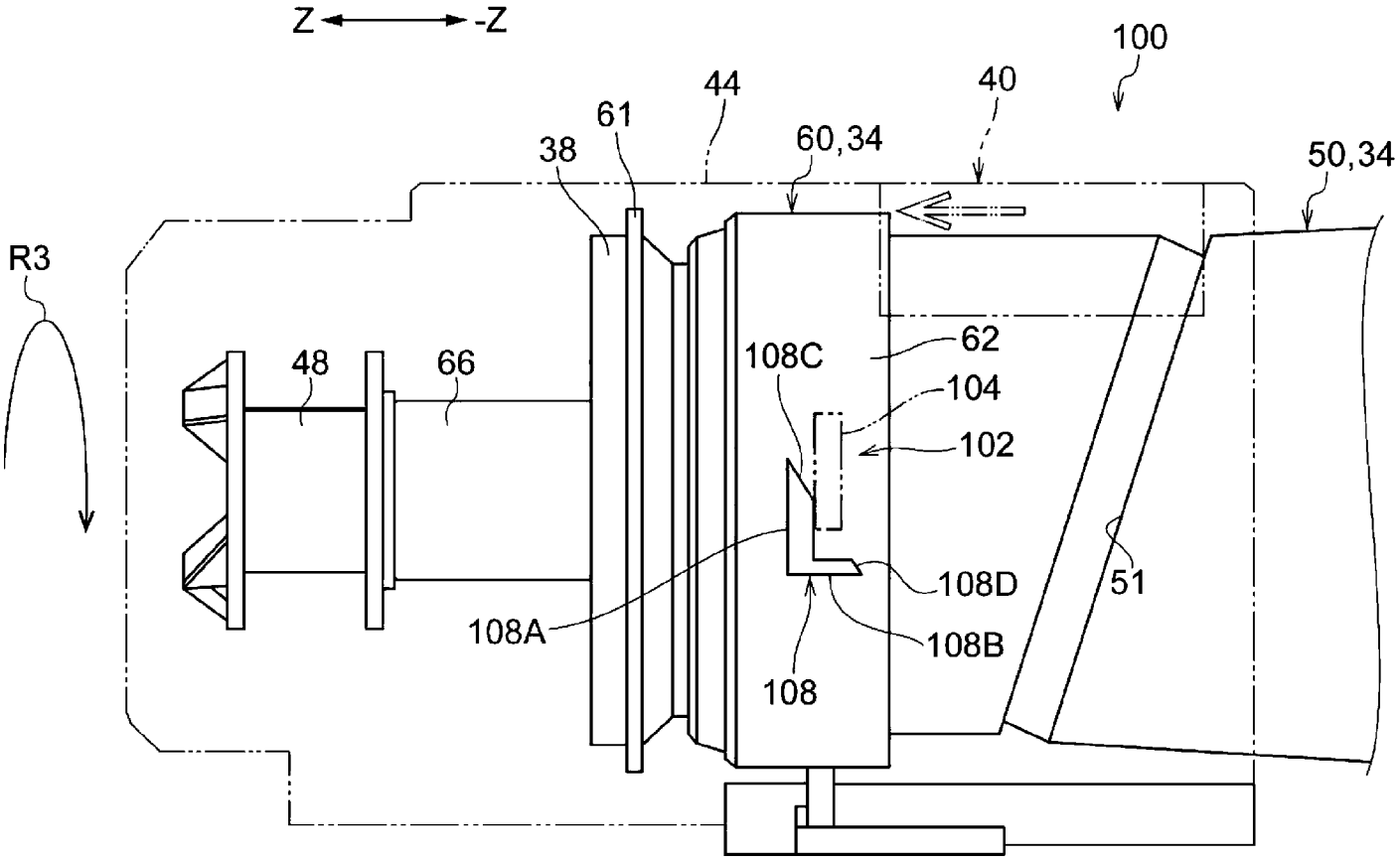
FIG. 7 is a side view of a structure of part of a toner cartridge according to a second exemplary embodiment, at a portion around a fixing portion when the head portion is rotated relative to the bottle portion in the first circumferential direction.

As illustrated in FIG. 7, a toner cartridge 100 serving as an example of a toner container according to a second exemplary embodiment includes a fixing portion 102 instead of the fixing portion 80 in the toner cartridge 30K according to the first exemplary embodiment. For example, the toner cartridge 100 accommodates black toner, but may accommodate toner of another color.

The fixing portion 102 includes a first protrusion 104 disposed on the inner peripheral surface of the outer peripheral wall 44 in the head portion 40, and a second protrusion 108 disposed on the outer peripheral surface of the receiving portion 60 in the bottle portion 34 and on which the first protrusion 104 is locked. The first protrusion 104 is an example of a to-be-locked portion, and the second protrusion 108 is an example of a locking portion.

Figure 8A:
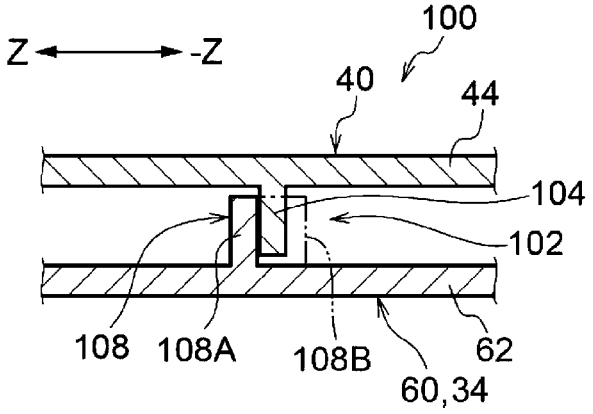
FIG. 8A is a cross-sectional view of the fixing portion of the toner cartridge according to the second exemplary embodiment, where a first protrusion in the head portion and a second protrusion in the bottle portion are engaged with each other.
Figure 8B:
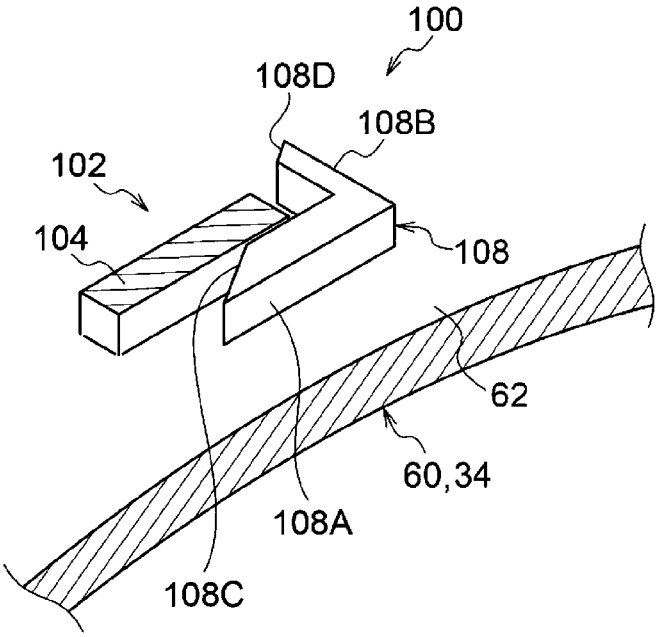
FIG. 8B is a perspective view of the first protrusion in the head portion and the second protrusion in the bottle portion engaged with each other.

As illustrated in FIGS. 8A and 8B, the first protrusion 104 protrudes radially inward from the inner peripheral surface of the outer peripheral wall 44 in the head portion 40. For example, when viewed in a direction perpendicular to the axial direction of the head portion 40, the first protrusion 104 has a rectangular shape having its length in the circumferential direction.

The second protrusion 108 protrudes radially outward from the outer peripheral surface of the peripheral wall 62 in the receiving portion 60. For example, the second protrusion 108 has a letter L shape when viewed in the direction perpendicular to the axial direction of the receiving portion 60. More specifically, the second protrusion 108 includes a body portion 108A extending in the circumferential direction of the receiving portion 60, and a restriction portion 108B extending from one end portion of the body portion 108A toward the bottle body 50 (refer to FIG. 7). The body portion 108A is capable of coming into surface contact with a side surface of the first protrusion 104. As illustrated in FIG. 7, the restriction portion 108B is disposed at an end portion of the body portion 108A on a downstream side in a direction in which the head portion 40 is rotated relative to the bottle portion 34 in the first circumferential direction (direction of arrow R3).

At a distal end portion (an end portion away from the restriction portion 108B) of the body portion 108A, a taper portion 108C inclined, toward the distal end, in a direction further from the bottle body 50 is disposed. At a distal end portion (an end portion away from the body portion 108A) of the restriction portion 108B, a taper portion 108D inclined, toward the distal end, in a direction opposite to the direction in which the body portion 108A extends is disposed.

As illustrated in FIG. 7, when the first protrusion 104 comes into surface contact with the body portion 108A in the second protrusion 108 while the head portion 40 is rotated relative to the bottle portion 34 in the first circumferential direction (direction of arrow R3), the first protrusion 104 is locked on the second protrusion 108 (refer to FIGS. 8A and 8B). Thus, the bottle portion 34 and the head portion 40 are fixed to each other not to move away from each other in the axial direction. The restriction portion 108B in the second protrusion 108 functions as a stopper that restricts rotation of the first protrusion 104 in the first circumferential direction (direction of arrow R3) with a contact of the end surface of the first protrusion 104 in the longitudinal direction.

For example, when the head portion 40 is rotated relative to the bottle portion 34 in the first circumferential direction (direction of arrow R3) while the head portion 40 is pressed against the receiving portion 60 in the bottle portion 34, the first protrusion 104 is locked on the second protrusion 108. For example, the direction of arrow R3 is a direction in which the head portion 40 is rotated rightward relative to the bottle portion 34. In this case, the taper portion 108D in the body portion 108A in the second protrusion 108 allows the first protrusion 104 to slide over the taper portion 108D, and guides the first protrusion 104 to the position where the first protrusion 104 is locked on the body portion 108A.

Figure 9:
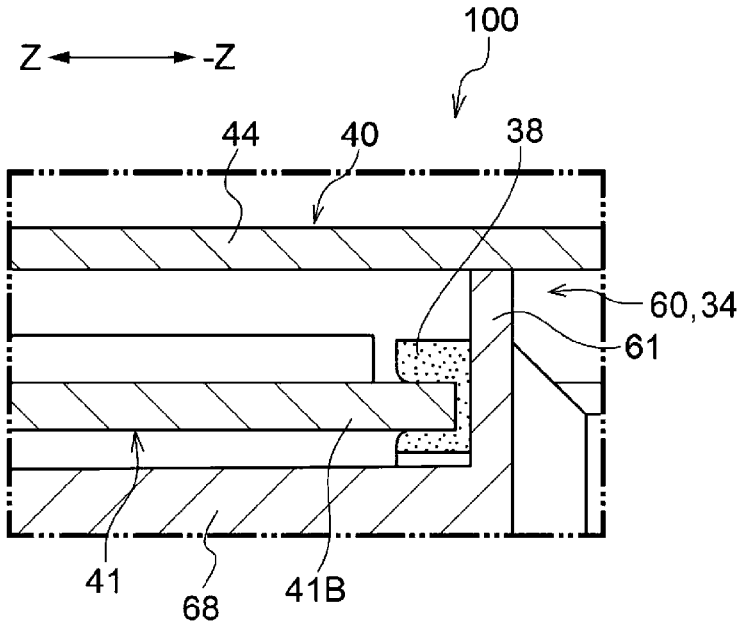
FIG. 9 is a cross-sectional view of a structure of part of the toner cartridge according to the second exemplary embodiment, at a portion around a sealant when the head portion is rotated relative to the bottle portion in the first circumferential direction.

When the first protrusion 104 is locked on the second protrusion 108, as illustrated in FIG. 9, the bottle portion 34 and the head portion 40 are fixed to each other while the sealant 38 interposed between the end portion 41B of the inner peripheral wall 41 in the head portion 40 and the annular wall 61 in the receiving portion 60 is compressed.

Figure 10:
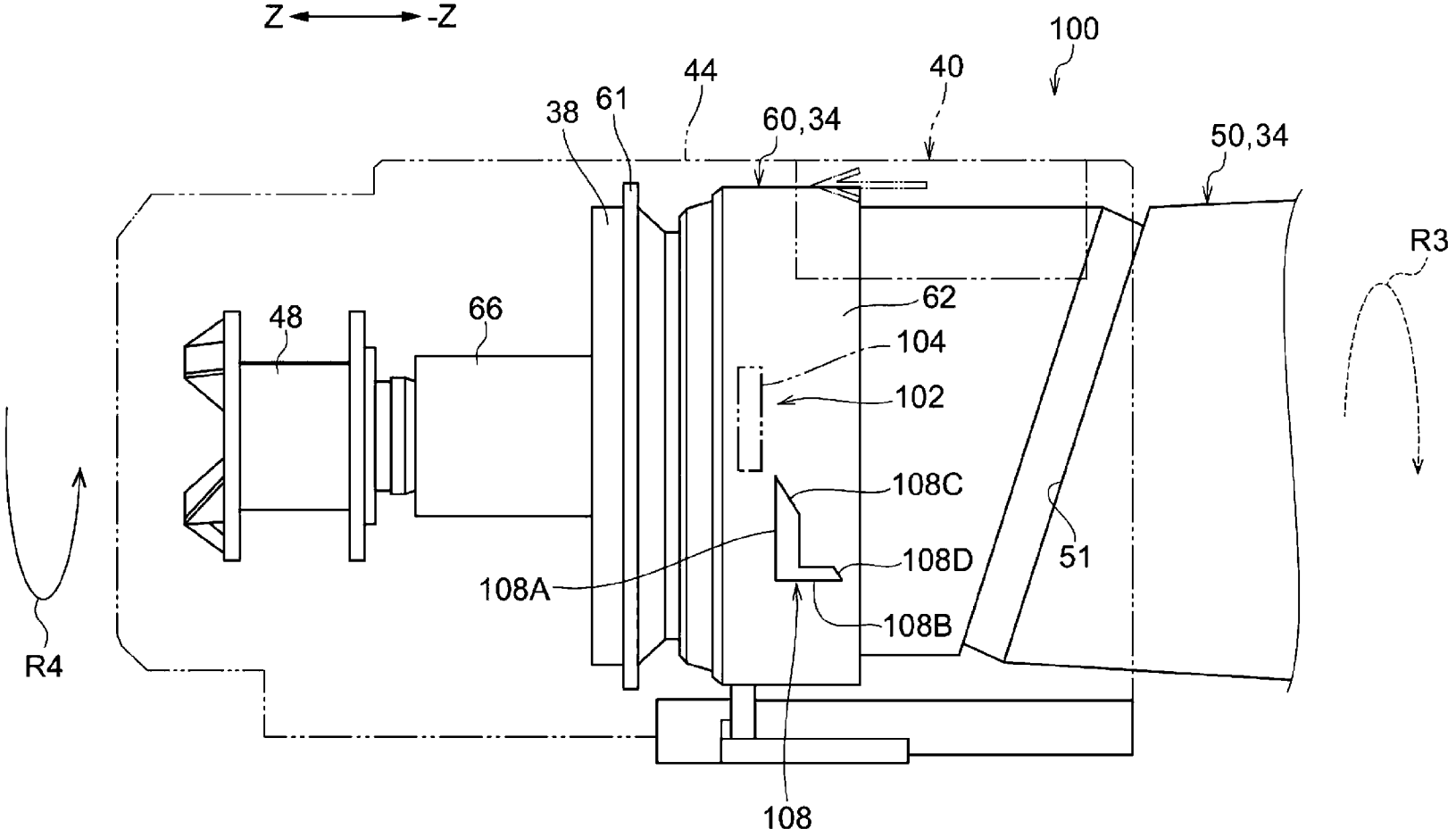
FIG. 10 is a side view of a structure of part of the toner cartridge according to the second exemplary embodiment, at a portion around the fixing portion when the head portion is rotated relative to the bottle portion in the second circumferential direction.
Figure 11A:
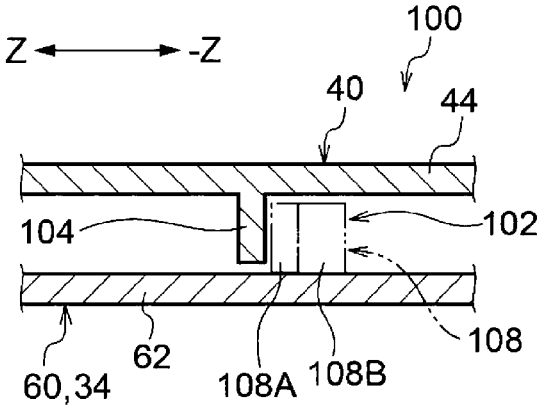
FIG. 11A is a cross-sectional view of the fixing portion of the toner cartridge according to the second exemplary embodiment, where the first protrusion in the head portion and the second protrusion in the bottle portion are disengaged from each other.
Figure 11B:
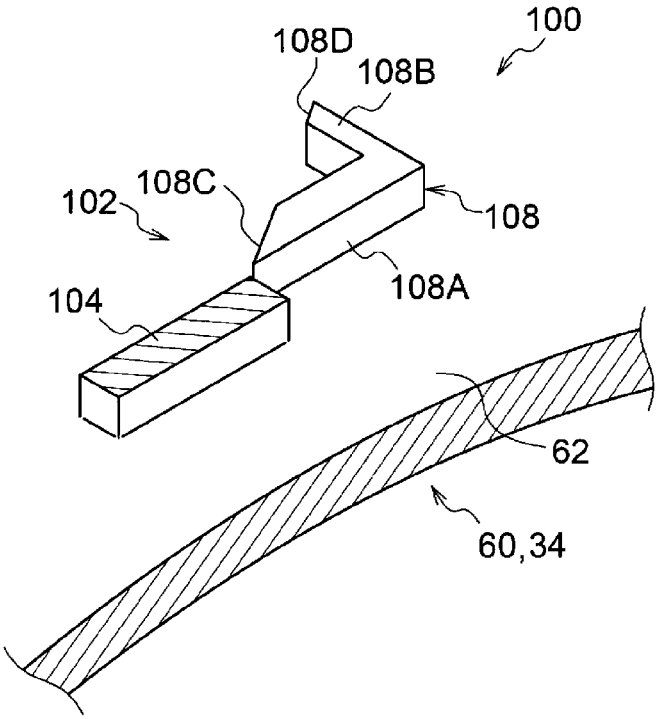
FIG. 11B is a perspective view of the first protrusion in the head portion and the second protrusion in the bottle portion disengaged from each other.
Figure 12:
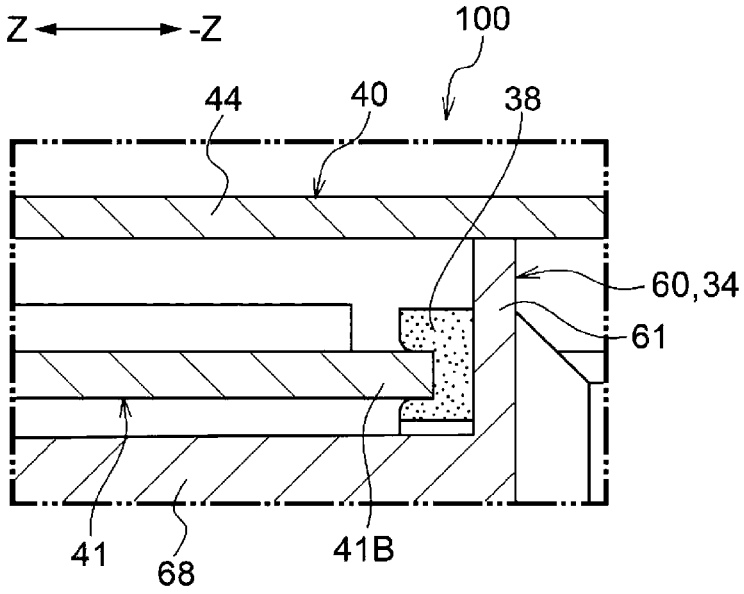
FIG. 12 is a cross-sectional view of a structure of part of the toner cartridge according to the second exemplary embodiment, at a portion around the sealant when the head portion is rotated relative to the bottle portion in the second circumferential direction.

When the toner cartridge 100 is attached to the attachment portion 22 in the image forming apparatus body 11, as illustrated in FIG. 10, the first protrusion 104 and the second protrusion 108 are disengaged from each other by rotating the head portion 40 relative to the bottle portion 34 in the second circumferential direction (direction of arrow R4) (refer to FIGS. 11A and 11B). Thus, as illustrated in FIG. 12, the fixing portion 102 unfastens the bottle portion 34 and the head portion 40 from each other to release the sealant 38 from the compression. More specifically, as a result of the first protrusion 104 and the second protrusion 108 being disengaged from each other, the head portion 40 and the bottle portion 34 move relative to each other in the directions to reduce the range where they overlap each other in the axial direction, and the positions of the first protrusion 104 and the second protrusion 108 in the axial direction are interchanged with each other (refer to FIG. 10). Thus, as illustrated in FIG. 12, the distance between the end portion 41B of the inner peripheral wall 41 and the annular wall 61 in the receiving portion 60 increases, and the sealant 38 is released from the compression.

In the state where the toner cartridge 100 is attached to the attachment portion 22 in the image forming apparatus body 11, the rotational force of the motor 28 (refer to FIG. 2) is transmitted to the receiving portion 60 in the bottle portion 34. In the second exemplary embodiment, the rotational force of the motor 28 is transmitted to the bottle portion 34 while the head portion 40 is fixed to the attachment portion 22 to rotate the bottle portion 34 (that is, the receiving portion 60) in the direction of arrow R3. Thus, the head portion 40 is rotatable relative to the bottle portion 34 (that is, the receiving portion 60) in the second circumferential direction (direction of arrow R4). Specifically, the direction in which the head portion 40 is rotated relative to the receiving portion 60 in the second circumferential direction (direction of arrow R4) is the same as the direction in which the toner is transported with rotation of the bottle portion 34.

The sealant 38 has a thickness set to separate the first protrusion 104 and the second protrusion 108 from each other as a result of the positions of the first protrusion 104 and the second protrusion 108 in the axial direction being interchanged with each other after the sealant 38 is restored from the compressed state.

Other components of the toner cartridge 100 are the same as the components of the toner cartridge 30K according to the first exemplary embodiment.

The toner cartridge 100 according to the second exemplary embodiment has the following operations in addition to the operations of the same components of the toner cartridge 30K according to the first exemplary embodiment.

In the toner cartridge 100, the fixing portion 102 includes the first protrusion 104 disposed on the inner peripheral surface of the outer peripheral wall 44 in the head portion 40, and the second protrusion 108 disposed on the outer peripheral surface of the receiving portion 60 in the bottle portion 34 and to which the first protrusion 104 is locked. Thus, the fixing portion 102 in the toner cartridge 100 is more easily manufacturable than a structure having a screw structure for fixing the head portion and the bottle portion to each other.

In the toner cartridge 100, the first protrusion 104 protrudes radially inward from the inner peripheral surface of the outer peripheral wall 44 in the head portion 40, and the second protrusion 108 protrudes radially outward from the outer peripheral surface of the peripheral wall 62 in the receiving portion 60. Thus, the fixing portion 102 in the toner cartridge 100 is more easily manufacturable than a structure where a protrusion protruding from the outer peripheral surface of the bottle portion is to be locked on a groove set back from the inner peripheral surface of the head portion.

In the toner cartridge 100, the sealant 38 has a thickness set to separate the first protrusion 104 and the second protrusion 108 from each other as a result of the positions of the first protrusion 104 and the second protrusion 108 in the axial direction being interchanged with each other after the sealant 38 is restored from the compressed state. The toner cartridge 100 thus further facilitates adjustment of unfastening of the head portion and the bottle portion from each other to release the sealant 38 from the compression than in the case where the sealant has a thickness thicker than the distance between the first protrusion and the second protrusion in the unfastened state.

In the toner cartridge 100, the second protrusion 108 includes the restriction portion 108B that comes into contact with the first protrusion 104 to restrict rotation of the head portion 40 in the first circumferential direction when the head portion 40 is rotated relative to the bottle portion 34 in the first circumferential direction (direction of arrow R3). Thus, the toner cartridge 100 further reduces disengagement of the first protrusion 104 and the second protrusion 108 from each other than in a structure where the first protrusion and the second protrusion come into with each other only at the surfaces perpendicular to the axial direction of the support portion.

Others

The present disclosure is not limited to the above exemplary embodiments, and may be modified, changed, or improved in various manners within the scope not departing from the gist thereof.

In the first exemplary embodiment, the fixing portion 80 includes the screw portion 82 disposed at the bottle portion 34, and the projections 86 disposed at the head portion 40 and fastened to the screw portion 82, but the present disclosure is not limited to this example. For example, the present disclosure may include a screw portion disposed at the head portion and projections disposed at the bottle portion and fastened to the screw portion.

In the first exemplary embodiment, the projections 86 are multiple pieces arranged in the helical direction of the screw portion 82, but the present disclosure is not limited to this example. For example, a projection may continuously extend in the helical direction of the screw portion.

In the second exemplary embodiment, the second protrusion 108 includes the restriction portion 108B that comes into contact with the first protrusion 104 to restrict rotation of the head portion 40 in the first circumferential direction when the head portion 40 is rotated relative to the bottle portion 34 in the first circumferential direction (direction of arrow R3), but the present disclosure is not limited to this example. For example, the restriction portion may be disposed at the first protrusion. In this case, the restriction portion may function as a stopper that comes into contact with the second protrusion to restrict rotation of the head portion 40 in the first circumferential direction when the head portion 40 is rotated relative to the bottle portion 34 in the first circumferential direction (direction of arrow R3).

In the first and second exemplary embodiments, the motor 28 in the image forming apparatus body 11 rotates the bottle portion 34, but the present disclosure is not limited to this example. For example, the motor in the image forming apparatus body may rotate the head portion. In this case, while the head portion is rotated by a determined amount relative to the bottle portion in the second circumferential direction, the head portion may come into contact with the stopper of the bottle portion and the head portion and the bottle portion may integrally rotate in the toner transport direction.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

APPENDIX (((1)))

A toner container, comprising:

a container that accommodates toner and transports, by rotating, the toner to an opening disposed at a first end portion in a direction of a rotation axis;

a support portion that covers a periphery of the container near the first end portion, and supports the container to be rotatable in a circumferential direction, the support portion being attached to an image forming apparatus body and having a sealant interposed between the support portion and the container; and a fixing portion that fixes the container and the support portion to each other while the sealant is compressed when the support portion is rotated relative to the container in a first circumferential direction.

(((2)))

The toner container according to (((1))), wherein the sealant has breathability.

(((3)))

The toner container according to (((1))) or (((2))), wherein the fixing portion rotates the support portion relative to the container in a second circumferential direction with a rotational force transmitted from a driving portion in the image forming apparatus body to unfasten the container and the support portion from each other to release the sealant from compression.

(((4)))

The toner container according to (((3))), wherein a direction in which the support portion is rotated relative to the container in the second circumferential direction is equal to a direction in which the toner is transported with rotation of the container.

(((5)))

The toner container according to any one of (((1))) to (((4))), wherein the fixing portion includes a screw portion disposed at either one of the support portion and the container, and a projection disposed at another one of the support portion and the container to be fastened to the screw portion while the support portion is rotated relative to the container in the first circumferential direction.

(((6)))

The toner container according to (((5))), wherein the fixing portion includes the screw portion disposed at the container and the projection disposed at the support portion.

(((7)))

The toner container according to (((5))) or (((6))), wherein the projection includes multiple pieces arranged in a helical direction of the screw portion.

(((8)))

The toner container according to any one of (((1))) to (((4))), wherein the fixing portion includes a to-be-locked portion disposed at an inner peripheral surface of the support portion, and a locking portion disposed at an outer peripheral surface of the container, and locked on the to-be-locked portion while the support portion is rotated relative to the container in the first circumferential direction.

(((9)))

The toner container according to (((8))), wherein the to-be-locked portion is a first protrusion that protrudes radially inward from an inner peripheral surface of the support portion, and wherein the locking portion is a second protrusion that protrudes radially outward from the container.

(((10)))

The toner container according to (((9))), wherein the sealant has a thickness set to separate the first protrusion and the second protrusion from each other as a result of positions of the first protrusion and the second protrusion in an axial direction being interchanged with each other after the sealant is restored from a compressed state.

(((11)))

The toner container according to (((9))) or (((10))), wherein either one of the first protrusion and the second protrusion includes a restriction portion that comes into contact with another one of the first protrusion and the second protrusion to restrict rotation of the support portion in the first circumferential direction while the support portion is rotated relative to the container in the first circumferential direction.

(((12)))

An image forming apparatus, comprising:

an image forming apparatus body;

an image carrier disposed at the image forming apparatus body to receive a latent image;

a development device disposed at the image forming apparatus body to develop the latent image; and the toner container according to any one of (((1))) to (((11))) that accommodates toner to be fed to the development device.

What is claimed is:

1. A toner container, comprising:

a container that accommodates toner and transports, by rotating, the toner to an opening disposed at a first end portion in a direction of a rotation axis;

a support portion that covers a periphery of the container near the first end portion, and supports the container to be rotatable in a circumferential direction, the support portion being attached to an image forming apparatus body and having a sealant interposed between the support portion and the container; and a fixing portion that fixes the container and the support portion to each other while the sealant is compressed when the support portion is rotated relative to the container in a first circumferential direction.

2. The toner container according to claim 1, wherein the sealant has breathability.

3. An image forming apparatus, comprising:

an image forming apparatus body;

an image carrier disposed at the image forming apparatus body to receive a latent image;

a development device disposed at the image forming apparatus body to develop the latent image; and the toner container according to claim 2 that accommodates toner to be fed to the development device.

4. The toner container according to claim 1, wherein the fixing portion rotates the support portion relative to the container in a second circumferential direction with a rotational force transmitted from a driving portion in the image forming apparatus body to unfasten the container and the support portion from each other to release the sealant from compression.

5. The toner container according to claim 4, wherein a direction in which the support portion is rotated relative to the container in the second circumferential direction is equal to a direction in which the toner is transported with rotation of the container.

6. An image forming apparatus, comprising:

an image forming apparatus body;

an image carrier disposed at the image forming apparatus body to receive a latent image;

a development device disposed at the image forming apparatus body to develop the latent image; and the toner container according to claim 5 that accommodates toner to be fed to the development device.

7. An image forming apparatus, comprising:

an image forming apparatus body;

an image carrier disposed at the image forming apparatus body to receive a latent image;

a development device disposed at the image forming apparatus body to develop the latent image; and the toner container according to claim 4 that accommodates toner to be fed to the development device.

8. The toner container according to claim 1, wherein the fixing portion includes:

a screw portion disposed at either one of the support portion and the container; and a projection disposed at another one of the support portion and the container to be fastened to the screw portion while the support portion is rotated relative to the container in the first circumferential direction.

9. The toner container according to claim 8, wherein the fixing portion includes the screw portion disposed at the container and the projection disposed at the support portion.

10. The toner container according to claim 9, wherein the projection includes multiple pieces arranged in a helical direction of the screw portion.

11. An image forming apparatus, comprising:

an image forming apparatus body;

an image carrier disposed at the image forming apparatus body to receive a latent image;

a development device disposed at the image forming apparatus body to develop the latent image; and the toner container according to claim 10 that accommodates toner to be fed to the development device.

12. An image forming apparatus, comprising:

an image forming apparatus body;

an image carrier disposed at the image forming apparatus body to receive a latent image;

a development device disposed at the image forming apparatus body to develop the latent image; and the toner container according to claim 9 that accommodates toner to be fed to the development device.

13. An image forming apparatus, comprising:

an image forming apparatus body;

an image carrier disposed at the image forming apparatus body to receive a latent image;

a development device disposed at the image forming apparatus body to develop the latent image; and the toner container according to claim 8 that accommodates toner to be fed to the development device.

14. The toner container according to claim 1, wherein the fixing portion includes:

a to-be-locked portion disposed at an inner peripheral surface of the support portion; and a locking portion disposed at an outer peripheral surface of the container, and locked on the to-be-locked portion while the support portion is rotated relative to the container in the first circumferential direction.

15. The toner container according to claim 14, wherein the to-be-locked portion is a first protrusion that protrudes radially inward from an inner peripheral surface of the support portion, and wherein the locking portion is a second protrusion that protrudes radially outward from the container.

16. The toner container according to claim 15, wherein the sealant has a thickness set to separate the first protrusion and the second protrusion from each other as a result of positions of the first protrusion and the second protrusion in an axial direction being interchanged with each other after the sealant is restored from a compressed state.

17. The toner container according to claim 15, wherein either one of the first protrusion and the second protrusion includes a restriction portion that comes into contact with another one of the first protrusion and the second protrusion to restrict rotation of the support portion in the first circumferential direction while the support portion is rotated relative to the container in the first circumferential direction.

18. An image forming apparatus, comprising:

an image forming apparatus body;

an image carrier disposed at the image forming apparatus body to receive a latent image;

a development device disposed at the image forming apparatus body to develop the latent image; and the toner container according to claim 15 that accommodates toner to be fed to the development device.

19. An image forming apparatus, comprising:

an image forming apparatus body;

an image carrier disposed at the image forming apparatus body to receive a latent image;

a development device disposed at the image forming apparatus body to develop the latent image; and the toner container according to claim 14 that accommodates toner to be fed to the development device.

20. An image forming apparatus, comprising:

an image forming apparatus body;

an image carrier disposed at the image forming apparatus body to receive a latent image;

a development device disposed at the image forming apparatus body to develop the latent image; and the toner container according to claim 1 that accommodates toner to be fed to the development device.

* * * * *